US006499566B2

(12) United States Patent
Ach

(10) Patent No.: US 6,499,566 B2
(45) Date of Patent: Dec. 31, 2002

(54) TENSIONING DEVICE FOR AT LEAST ONE TRAILING ROPE

(75) Inventor: Ernst Ach, Ebikon (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 09/819,558

(22) Filed: Mar. 28, 2001

(65) Prior Publication Data

US 2001/0025743 A1 Oct. 4, 2001

(30) Foreign Application Priority Data

Mar. 31, 2000 (EP) ..... 00810280

(51) Int. Cl.[7] ..... B66B 7/06
(52) U.S. Cl. ..... 187/264; 187/411; 187/412
(58) Field of Search ..... 187/264, 412, 187/411, 265

(56) References Cited

U.S. PATENT DOCUMENTS

| | | | | |
|---|---|---|---|---|
| 590,722 A | * | 9/1897 | Hall | 187/264 |
| 912,256 A | * | 2/1909 | Neenan | 187/264 |
| 3,882,968 A | * | 5/1975 | Suozzo | 187/264 |
| 5,509,503 A | * | 4/1996 | Salmon | 187/266 |

FOREIGN PATENT DOCUMENTS

| | | | |
|---|---|---|---|
| DE | 2 425 216 | | 12/1974 |
| DE | 4 334 253 | | 4/1994 |
| EP | 0 371 806 | | 6/1990 |
| EP | 0 402 148 | | 12/1990 |
| JP | 5310382 | * | 11/1993 |
| JP | 06 211 463 | | 11/1994 |
| JP | 09 156 850 | | 10/1997 |
| WO | 9829327 | * | 7/1998 |

* cited by examiner

*Primary Examiner*—Steven A. Bratlie
(74) *Attorney, Agent, or Firm*—MacMillan, Sobanski & Todd, LLC

(57) ABSTRACT

A trailing rope tensioning device for an elevator installation engages a trailing rope that extends from a first hitch point of a car frame to a second hitch point of a counterweight frame. The tensioning device has two tensioning pulleys that are arranged offset relative to a vertical direction of travel of the elevator and a transverse horizontal direction. This arrangement of the tensioning pulleys makes it possible to use relatively large tensioning pulleys resulting in a lower number of revolutions per unit of distance traveled, which brings about a reduction in noise from the bearings rotatably mounting the pulleys. Larger diameters of trailing rope and, as a result, fewer trailing ropes can be used. Furthermore, the tensioning pulleys can be standardized.

8 Claims, 1 Drawing Sheet

TENSIONING DEVICE FOR AT LEAST ONE TRAILING ROPE

BACKGROUND OF THE INVENTION

The present invention relates a tensioning device for at least one trailing rope in an elevator installation. Within the meaning of the invention, a trailing rope can also be a compensating rope, a compensating chain, or similar flexible connection. The terms "vertical" and "horizontal" relate to the direction of travel of the elevator. "Vertical" means the direction essentially parallel to the direction of travel of the elevator, and "horizontal" means the direction essentially perpendicular to it.

Tensioning devices for trailing ropes have long been known, and are primarily used on traction elevators. The purpose of the tensioning device is, inter alia, to tension the trailing ropes, limit rope vibrations, and prevent the counterweight or elevator car from jumping.

In the German patent specification DE 43 34 253, the trailing rope tensioning device is provided with a single large rope pulley. Disadvantages of this rope pulley are the large amount of space required in the bearing, and that it is not standardized, since it always has to be manufactured individually depending on the size of the elevator installation.

As may be seen from the German patent specification DE 24 25 216, a trailing rope tensioning device is provided with two pulleys of minimal allowable diameter. Disadvantages of this embodiment are the high speed of rotation of the rope pulleys, which increases the noise from the bearings, and the use of several ropes of small diameter.

SUMMARY OF THE INVENTION

A purpose of the present invention is to create a tensioning device for at least one trailing rope which does not possess the aforementioned disadvantages, and which permits the use of larger, less noisy tensioning pulleys as well as larger diameters of trailing rope. A further advantage of the present invention is that relatively large standardized pulleys can be used.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
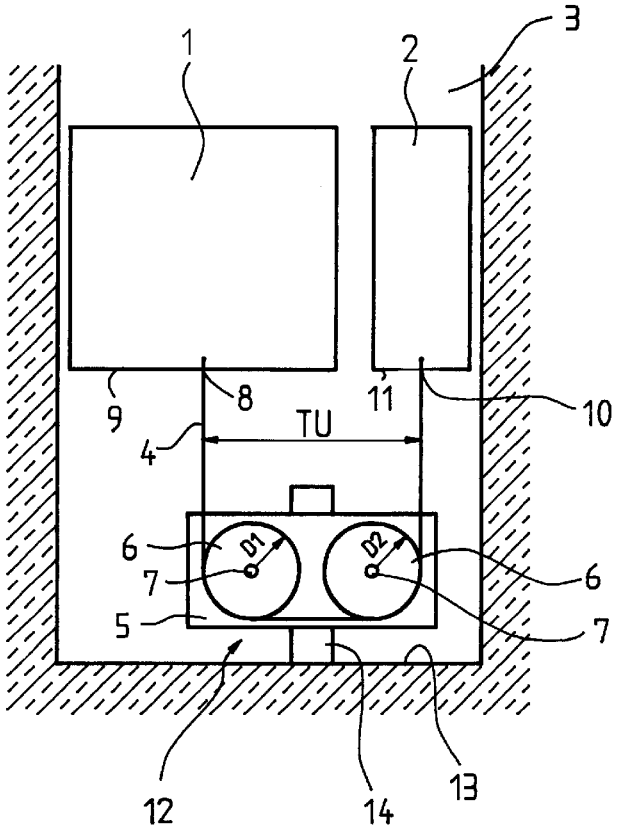
Fig. 1 Prior Art
FIG. 1 is a schematic view of a lower portion of an elevator installation having a prior art trailing rope tensioning device in accordance with the present invention.

In FIG. 1 there is shown a prior art elevator installation including an elevator car 1 and a counterweight 2 that are guided in a hoistway 3 by means of guides (not shown) and are connected to each other by at least one trailing rope 4 extending over a tensioning device 5. The tensioning device 5 is mounted in a bottom of the hoistway 3 and has two tensioning pulleys 6 rotatably mounted by shafts 7 in a common plane. The trailing rope 4 is fastened at a car end to a first hitch point 8 of a car frame 9, which is essentially at a midpoint of a width of a floor of the car 1.

At a counterweight end, the trailing rope 4 is fastened to a second hitch point 10 of a counterweight frame 11, which is essentially at a midpoint of a width of a bottom of the counterweight 2. The trailing rope 4 can be fastened directly or indirectly, for example with the assistance of springs, to the car frame 9 and the counterweight frame 11. The tensioning pulleys 6 have diameters D1 and D2, that are of equal length. A horizontal distance TU separating the first hitch point 8 and second hitch point 10, hereinafter referred to as the trailing rope separation TU, is greater than the sum of the two diameters D1 and D2. The two tensioning pulleys 6 are mounted in a pulley frame 12, which frame is vertically movable in a guide 14 fastened to a hoistway floor 13.

In this known solution, the tensioning pulleys 6 are quite small in diameter. Due to the predetermined trailing rope separation TU, the sum of the diameters D1 and D2 cannot be greater than the trailing rope separation TU. The smaller the diameter of the tensioning pulley, the higher the number of revolutions per unit of distance traveled by the elevator car 1. The relatively small tensioning pulleys 6 therefore have a high speed of rotation, which causes disturbing noise from the bearings (not shown) providing the rotatable mounting. At the same time, it is only possible to use trailing ropes of small diameter and in large numbers.

Figure 2:
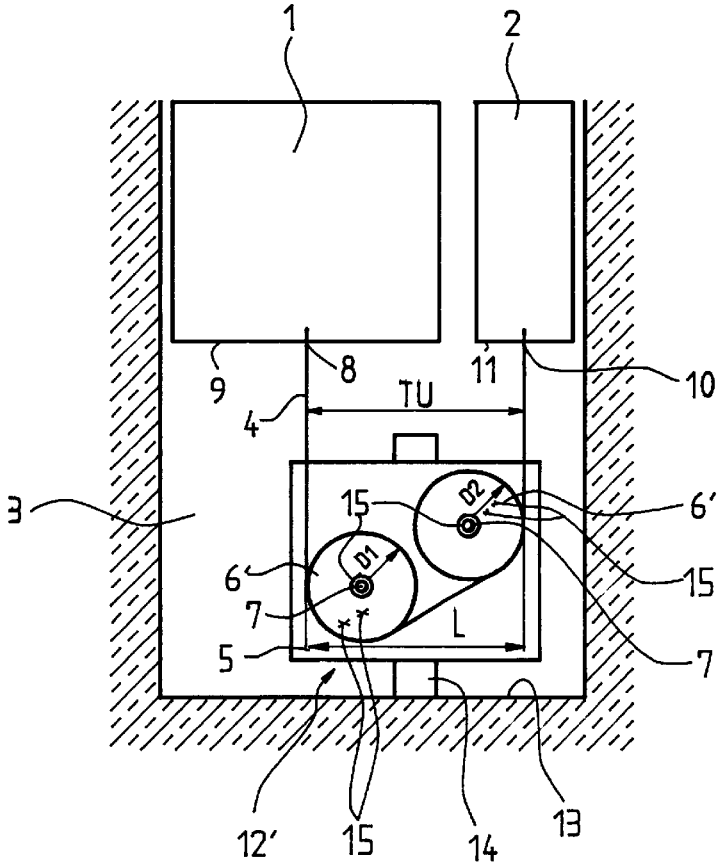
FIG. 2 is a schematic view of a lower portion of an elevator installation having a trailing rope tensioning device in accordance with the present invention.

FIG. 2 illustrates an embodiment according to the present invention in which, under tie same conditions as in the prior an device, larger tensioning pulleys can be used. In FIG. 2, the same elements of the elevator installation are shown with the same reference numbers as used in FIG. 1. For the sake of simplicity, only one trailing rope 4 is shown. It is self-evident that the same also applies if several trailing ropes are used. As can be seen from FIG. 2, a pair of tensioning pulleys 6' are arranged in the pulley frame 12. The pulley frame 12 is generally a supporting structure for the tensioning pulleys which can, for example, take the form of a casing 12'. The pulley fame 12' is vertically movable in the guide 14 fastened to the hoistway floor 13. The tensioning pulleys 6' are rotatably mounted with an axis of rotation at the shaft 7 at different heights relative to the hoistway floor 13. In this embodiment, the tensioning pulleys 6' at different heights have diameters D1 and D2 of equal size whose sum is greater than the trailing rope separation TU. A length L of the vertical projection of the two tensioning pulleys 6' on a horizontal plane preferably corresponds essentially to the trailing rope separation TU, that is to say, in the horizontal direction the tensioning pulleys 6' extend over the length L, which is essentially the same as the trailing rope separation TU. By means of the tensioning device according to the present invention, parallel movement of the trailing rope 4 in the area between the car 1 and the tensioning pulley 6' lying nearest to it, and in the area between the counterweight 2 and the tensioning pulley 6' lying nearest to it, is achieved.

This special arrangement of the tensioning pulleys 6' makes it possible to use larger tensioning pulleys than in the prior art tensioning device shown in FIG. 1. As a result, the number of revolutions per unit of distance traveled is smaller, which brings about a reduction in noise from the bearings. Larger trailing rope diameters and, as a result, fewer of the trailing ropes 4 can be used. Furthermore, the tensioning pulleys 6' can be standardized so that, thanks to the flexible arrangement according to the present invention, they can be used on different elevator installations.

The trailing ropes 4 can be connected to each other by means which allow the trailing ropes to be moved relative to each other in a linear direction and/or in a direction of rotation. In other words, the distance between the shafts 7 of the two tensioning pulleys 6' and/or the spatial arrangement of the pulleys relative to each other can be adjusted This can be achieved by, for example, the easing 12 being provided with several holes 15 that allow the shafts 7 of the tensioning pulleys 6' to be fastened in various different positions. The fastenings can generally be effected with the aid of fastening means such as screws (not shown). In this manner, the adaptability of the tensioning pulleys to the various different elevator installations is increased.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for tensioning at least one trailing rope connecting an elevator car to a counterweight, the car and the counterweight traveling in an elevator hoistway, comprising:

a casing adapted to be mounted in the elevator hoistway and having a plurality of mounting holes formed therein; and a pair of tensioning pulleys rotatably mounted on said casing for engaging the railing rope, an axis of rotation of one of said pulleys being offset vertically and horizontally from an axis of rotation of another of said pulleys, each said pulley being attached to an associated pulley shaft releasably received in a selected one of said mounting holes.

2. The apparatus according to claim 1 wherein the trailing rope has one end connected to a first hitch point on the car and an opposite end connected to a second hitch point on the counterweight, the first and second hitch points being separated by a predetermined horizontal distance (TU), and wherein a sum of diameters of said pulleys is greater than the distance (TU).

3. The apparatus according to claim 2 wherein a horizontal length (L) of a maximum vertical projection of said pulleys is approximately equal to the distance (TU).

4. The apparatus according to claim 1 wherein said pulleys are equal in diameter.

5. The apparatus according to claim 1 including a guide adapted to be fastened to a floor of the hoistway and wherein said casing is mounted on said guide for vertical movement.

6. The apparatus according to claim 1 wherein the axis of rotation of at least one of said pulleys is movable relative to the axis of rotation of another of said pulleys.

7. An apparatus for tensioning at least one trailing rope connecting an elevator car to a counterweight, the car and the counterweight traveling in an elevator hoistway, comprising:

a casing adapted to be mounted in the elevator hoistway and having a plurality of mounting holes formed therein;

a trailing rope having one end connected to a first hitch point on the car and an opposite end connected to a second hitch point on the counterweight, the first and second hitch points being separated by a predetermined horizontal distance (TU); and a pair of tensioning pulleys rotatably mounted on said casing and engaging the trailing rope, an axis of rotation of one of said pulleys being offset vertically and horizontally from an axis of rotation of another of said pulleys, each said pulley being releasably retained in a selected one of said holes and wherein a sum of diameters of said pulleys is greater than the distance (TU).

8. An elevator installation comprising:

an elevator car and a counterweight traveling in an elevator hoistway;

a trailing rope connected between said car and said counterweight;

a casing mounted in the elevator hoistway and having a plurality of mounting holes formed therein; and a pair of tensioning pulleys rotatably mounted on said casing and engaging said trailing rope, an axis of rotation of one of said pulleys being offset vertically and horizontally from an axis of rotation of another of said pulleys, each said pulley being releasably retained in a selected one of said holes.

* * * * *